US005468199A

United States Patent [19]

Keeler et al.

[11] Patent Number: 5,468,199

[45] Date of Patent: Nov. 21, 1995

[54] SLIDING-HANDGRIP AMUSEMENT APPARATUS

[75] Inventors: Russell L. Keeler; John M. Underbrink, both of Olympia, Wash.

[73] Assignee: BigToys, Inc., Olympia, Wash.

[21] Appl. No.: 168,957

[22] Filed: Dec. 17, 1993

[51] Int. Cl.[6] ..... A63G 21/20

[52] U.S. Cl. ..... 482/35; 482/143; 104/62

[58] Field of Search ..... 482/35–37, 69, 482/143, 148; 104/62

[56] References Cited

U.S. PATENT DOCUMENTS

| | | | |
|---|---|---|---|
| 3,090,617 | 5/1963 | Hjelte et al. | 482/143 |

FOREIGN PATENT DOCUMENTS

| | | | |
|---|---|---|---|
| 2848098 | 5/1980 | Germany | 482/37 |
| 1664981 | 4/1991 | U.S.S.R. | 482/36 |
| 8002402 | 11/1980 | WIPO | 482/37 |

*Primary Examiner*—Richard J. Apley

*Assistant Examiner*—John Mulcahy

*Attorney, Agent, or Firm*—Christensen, O'Connor, Johnson & Kindness

[57] ABSTRACT

A playground apparatus (10) for children to slide across while hanging by their hands is disclosed. The apparatus includes a support structure (12, 16, and 20) holding multiple rails (18), preferably five, horizontally above the ground and above the heads of the children. The rails are generally parallel one to another and include gentle curves along their length. Handhold assemblies (22) are slidably coupled to each of the rails and include two grips (40) on each assembly for users' hands. The grips are disposed below the rails and the handhold assemblies include partitions (46) between the rails and the grips to protect the children's hands from the rails. The handhold assemblies include channels (44) in which the rails are received and allowed to slide. The channels are wider in their middle portions than at their ends to accommodate the curves in the rails. Platforms (26) are constructed at the ends of the support structure to provide a place for the children to stand when reaching the handhold assemblies.

3 Claims, 4 Drawing Sheets

SLIDING-HANDGRIP AMUSEMENT APPARATUS

FIELD OF THE INVENTION

This invention relates generally to playground, amusement, and exercise equipment and, more particularly, to a playground apparatus having an upright array of horizontally extending elements.

BACKGROUND OF THE INVENTION

Children need both mental and physical stimuli for healthy development. Standard playground equipment can be enticing to children and can help them develop physically by keeping them strong and trim. However, if that playground equipment is not challenging and fun or is excessively challenging, children will either not try it at all or will quickly tire of the equipment and not use it, thus not gaining the benefits. Children may describe the equipment as "boring" if it is not mentally challenging.

One example of an overhead traversing device is playground equipment commonly referred to as monkey bars. With this device the user traverses, feet off the ground, hand over hand from one end to the other. The activity can be physically challenging, but there is little room for creativity, group play, or games. The activity can be tiresome and may not be repeatedly or extensively used.

Like the monkey bars, most standard playground equipment is designed for and used by a child individually. It can be physically challenging but may be tiresome and, therefore, may go unused. Common playground equipment seldom provides enjoyment for both the individual or group and can be used in many different ways to stimulate creativity and fun as children devise their own games and other activities.

SUMMARY OF THE INVENTION

The apparatus of the present invention is both mentally and physically challenging and can be fun for one or multiple children to play on together, as they make up games and activities, or individually, as they test their own abilities and limits. The apparatus is safe while providing both easy beginner activities and challenging, advanced fun and skill-testing activities. The device can aid in longlasting mental and physical development.

The present invention provides an amusement apparatus that includes a plurality of rails, handgrip assemblies, and a support structure. The plurality of rails are fixedly positioned above the users of the apparatus by the support structure. The rails have first and second ends. The handgrip assemblies are slidably coupled to the rails. Each of the handgrip assemblies includes at least one handle and a surface on which to ride on one of the rails. The handgrip assemblies are arranged and configured such that the users can advance along the rails from one end to the other while hanging from two of the handgrips. Preferably, the rails are substantially horizontal.

In the preferred embodiment of the invention, the apparatus further includes a platform disposed beneath one end of the rails on which a user can stand to reach the handgrip assemblies.

As one aspect of the preferred embodiment of the invention, the rails are equally spaced relative to each other along substantially all their length. Also in the preferred embodiment, the handgrip assemblies each include a channel slidably engaging one of the rails. The rails include curved portions along their length and the channels are wider near their middles than near their open ends, so that the handgrip assemblies accommodate the curved portions of the rails. In one preferred embodiment of the invention, the handgrip assemblies each include two handles. Each handgrip assembly also includes a partition between the handles and the channel. A block is secured within an upper side of each of the channels. Each of the blocks slides on the top of one of the rails.

The invention may also be defined as an apparatus for a user to slide across while hanging by the user's hands. The apparatus includes a support structure, a first rail, a second rail, a first slider, and a second slider. The first rail is attached to the support structure above the head of the user. The second rail is attached to the support structure in an adjacent, spaced relationship to the first rail. The first slider is frictionally engaged to the first rail and includes at least one first grip for the user's hand. The first grip is disposed below the first rail. The first slider is movable by the user along the first rail when most of the weight of the user is not being supported by the first slider on the first rail. The second slider is frictionally engaged to the second rail and includes at least one second grip for the user's hand. The second grip is disposed below the second rail. The second slider is movable by the user along the second rail when most of the weight of the user is not being supported by the second slider on the second rail.

In the preferred embodiment, the first and second rails are disposed substantially along a horizontal plane. Also, preferably, the first and second rails are curved.

The first and second slider assemblies include slider channels in which the rails are received. The slider channels have lateral sides that curve outwardly toward their middles to accommodate the rails that are curved. The slider channels are disposed above the grips and the sliders include partitions between the slider channels and the grips to protect the hands of the user from contact with the rails. Preferably, each slider includes at least two grips. One grip is disposed in front of the other such that at least two users can grasp one slider.

In one preferred embodiment, the apparatus also includes a third rail. The third rail is attached to the support structure in an adjacent, spaced relationship to the second rail. This embodiment also includes a third slider slidably coupled to the third rail and including at least one third grip for the user's hand. The third grip is disposed below the third rail, making the third slider movable by the user along the third rail. The third slider provides friction on the third rail. This embodiment also includes a fourth slider slidably coupled to the second rail in series with the second slider. The fourth slider includes at least one fourth grip for the user's hand. The fourth grip is disposed below the second rail. The fourth slider is movable by the user along the second rail and provides friction on the second rail.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
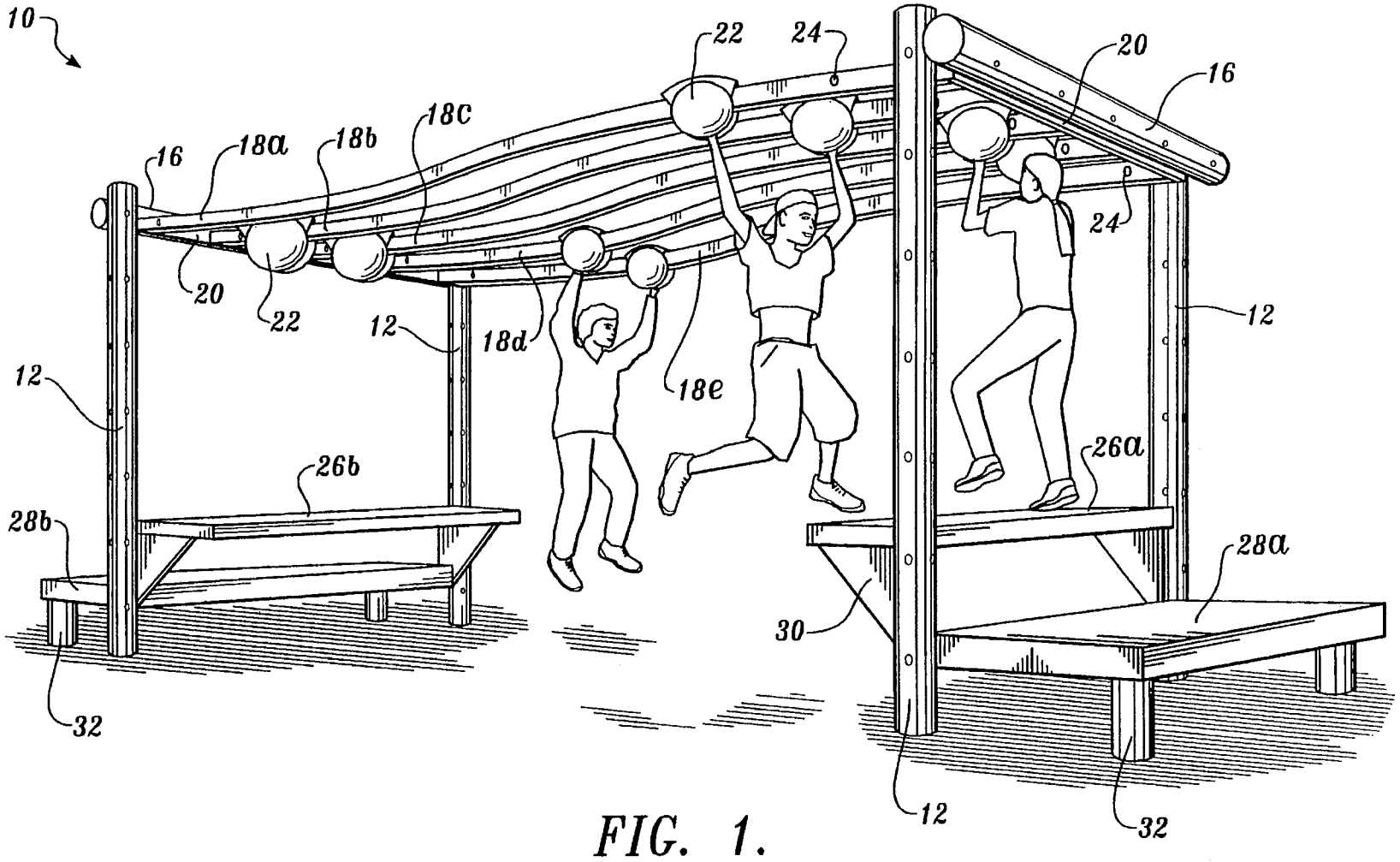
FIG. 1 is a perspective view of the playground apparatus of the present invention, illustrating its use by a few individuals.

FIG. 1 illustrates a playground structure 10 that is a preferred embodiment of the invention. Playground structure 10 includes upright poles 12, horizontal poles 16, rails 18, crossbeams 20, and handgrip assemblies 22. Four upright poles 12 are vertically set within ground 14 to support all components of playground structure 10. In the preferred arrangement of playground structure 10, imaginary lines along the ground between upright poles 12 form a parallelogram. Upright poles 12 are preferably constructed of treated wood and have circular diameters.

Two horizontal poles 16 interconnect the tops of upright poles 12, one horizontal pole 16*a* between a first set of upright poles 12*a* and 12*b* and another horizontal pole 16*b* between a second set of upright poles 12*c* and 12*d*. Thus, horizontal poles 16 are not only horizontal, but are parallel to each other. Horizontal poles 16 are preferably made of treated wood similar to upright poles 12 and are bolted to upright poles 12.

Rails 18 extend between horizontal poles 16*a* and 16*b*. Rails 18 have rectangular cross sections, with their major cross-sectional axes being vertical. The longitudinal axes of rails 18 are horizontal, the rails extending from one side of playground structure 10 to the other. In the preferred embodiment of the invention, five rails 18 are used and extend parallel to one another along curvilinear paths from one horizontal pole 16 to the other. Rails 18 are preferably constructed of stainless steel and are bent in gentle S-shaped configurations. Both ends of rails 18 terminate just inside of horizontal poles 16 perpendicular to horizontal poles 16 such that the gentle S-shaped curves simply account for the lateral shift in positioning of the upright poles and horizontal poles configured in a parallelogram.

The ends of rails 18 are bolted to crossbeams 20, which are in turn attached to horizontal poles 16. Thus, one crossbeam 20 is provided on the inner face of each of horizontal poles 16. Crossbeams 20 are also constructed of stainless steel and are rectangular in cross section with their major cross-sectional axes being vertical. The longitudinal axes of crossbeams 20 are parallel to horizontal poles 16.

Handgrip assemblies 22 are slidably coupled to rails 18. Handgrip assemblies 22 provide a place for the users to grasp when using playground structure 10. Further details of handgrip assemblies 22 will be discussed below in connection with FIGS. 3A and 3B. Stops 24 are preferably provided at each end of each of rails 18. Stops 24 are preferably plastic blocks that are fastened to the sides of rails 18. Stops 24 impede the movement of handgrip assemblies 22 so that they do not collide with upright poles 12, crossbeams 20, or other structures that may damage handgrip assemblies 22.

Launch platforms 26 and steps 28 are provided for the users, since normally when a user is traversing rails 18 by using handgrip assemblies 22, the user's feet are not touching the ground. Launch platform 26*a* is secured between upright poles 12*a* and 12*b*, and launch platform 26*b* is secured between upright poles 12*c* and 12*d*. Launch platforms 26 are preferably rectangular and positioned horizontally for the user to stand on before and after traversing rails 18. Launch platforms 26 are preferably constructed of wood with support gussets 30 to strengthen them. Support gussets 30 are triangular in shape and are attached vertically beneath the sides of launch platforms 26 and to upright poles 22. Support gussets 30 are in the shape of 45-degree right triangles, the right angles being secured between the top surface of launch platforms 26 and the insides of upright poles 12.

Steps 28 are preferably provided adjacent and below launch platforms 26 for easier access to launch platforms 26. Steps 28 project away from launch platforms 26 on the outside of the parallelogram formed by upright poles 12. Steps 28 are also rectangular in shape and are secured on one side to upright poles 12, step 28*a* being secured between upright poles 12*a* and 12*b*, while step 28*b* is secured between upright poles 12*c* and 12*d*. The outward sides of steps 28 are supported by step legs 32. Step legs 32 are preferably anchored to ground 14. Steps 28 are also preferably constructed of wood. Alternatively, other materials may be used, such as steel or plastic.

Figure 2:
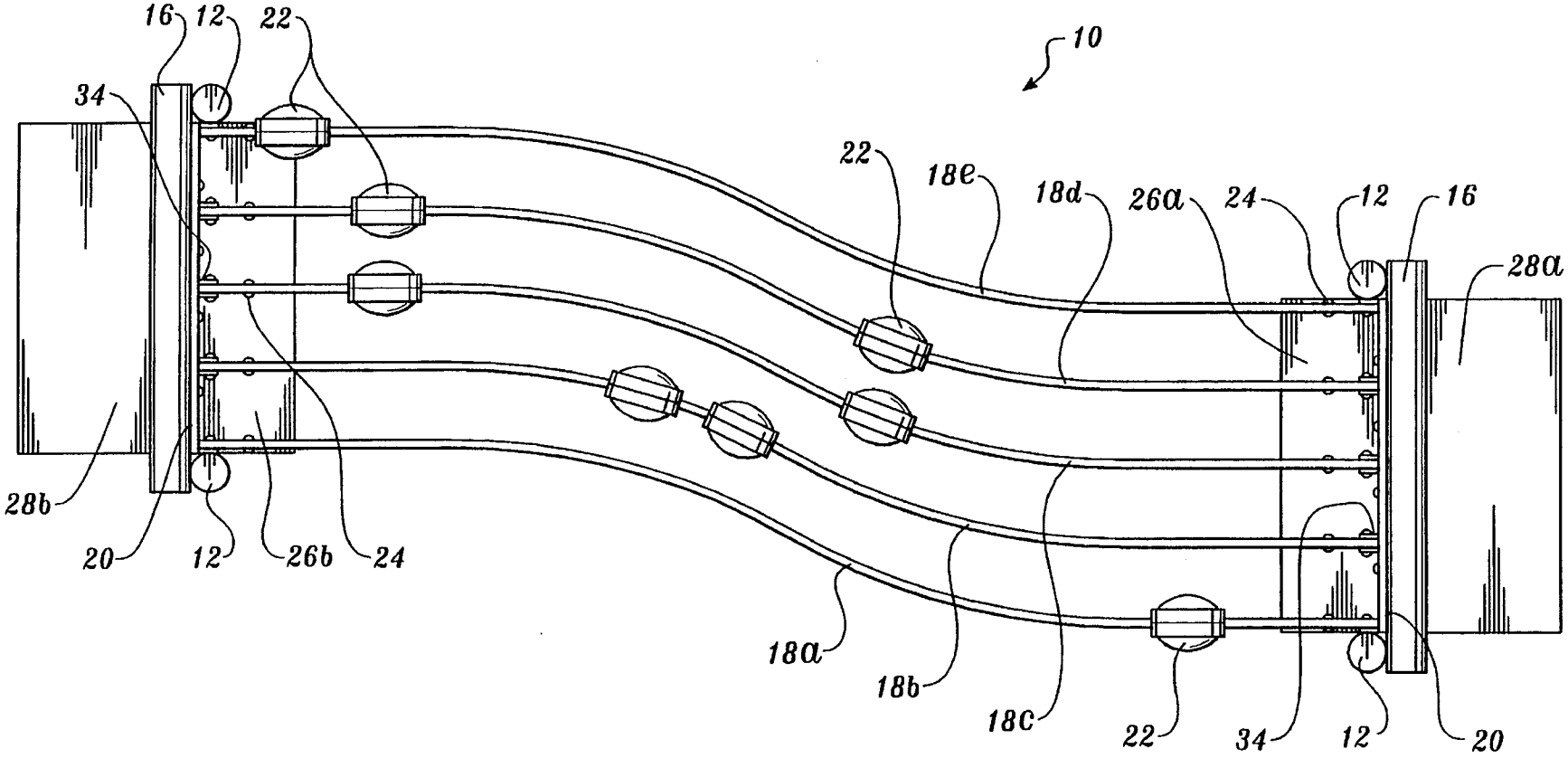
FIG. 2 is a plan view of the playground apparatus illustrated in FIG. 1.

Other details of playground structure 10 are better illustrated in FIG. 2. The perpendicular attachment of rails 18 to crossbeams 20 is shown. Tabs 34 are welded or otherwise attached to crossbeams 20. Tabs 34 are used with bolts extending through their sides to secure rails 18 in place. Tabs 34 are provided in pairs for middle rails 18*b* through 18*d*. For outer rails 18*a* and 18*e*, tabs are provided on the ends of crossbeams 20, rails 18*a* and 18*e* being placed on the inside of tabs 34 with screws or other fasteners extending through rails 18*a* and 18*e* and into tabs 34.

In the preferred embodiment of the invention, one handgrip assembly is provided on each of outer rails 18*a* and 18*e*, while two handgrip assemblies 22 are provided on each of inner rails 18*b* through 18*d*. Since a user will typically grasp two separate handgrip assemblies 22 on two separate rails 18, this arrangement allows at least one user to be hanging between rails 18*a* and 18*b*, while another user can be hanging between rails 18*b* and 18*c* on completely separate handgrip assemblies 22. Such an arrangement increases the variety of activities that can be carried out with playground structure 10. As will be explained below, each handgrip assembly preferably includes two handles such that two different users could potentially be grasping each handgrip assembly 22. This also greatly increases the variety of activities that may be played on playground structure 10.

Playground structure 10 is used by grasping one handgrip assembly 22 in each hand while standing on one of launch platforms 26. The user then steps off launch platform 26 so he is hanging from handgrip assemblies 22. By placing weight principally on one handgrip assembly, the user can slide the other handgrip assembly forward along one of rails 18. The user then transfers his weight to the forwardmost handgrip assembly 22 and slides the other handgrip assembly 22 forward. This weight shifting and sliding continues until the user traverses the length of rails 18 and reaches the other launch platform 26. From these basic maneuvers a virtually infinite number of variations and activities can be played by both the individual and the group.

Figure 3A:
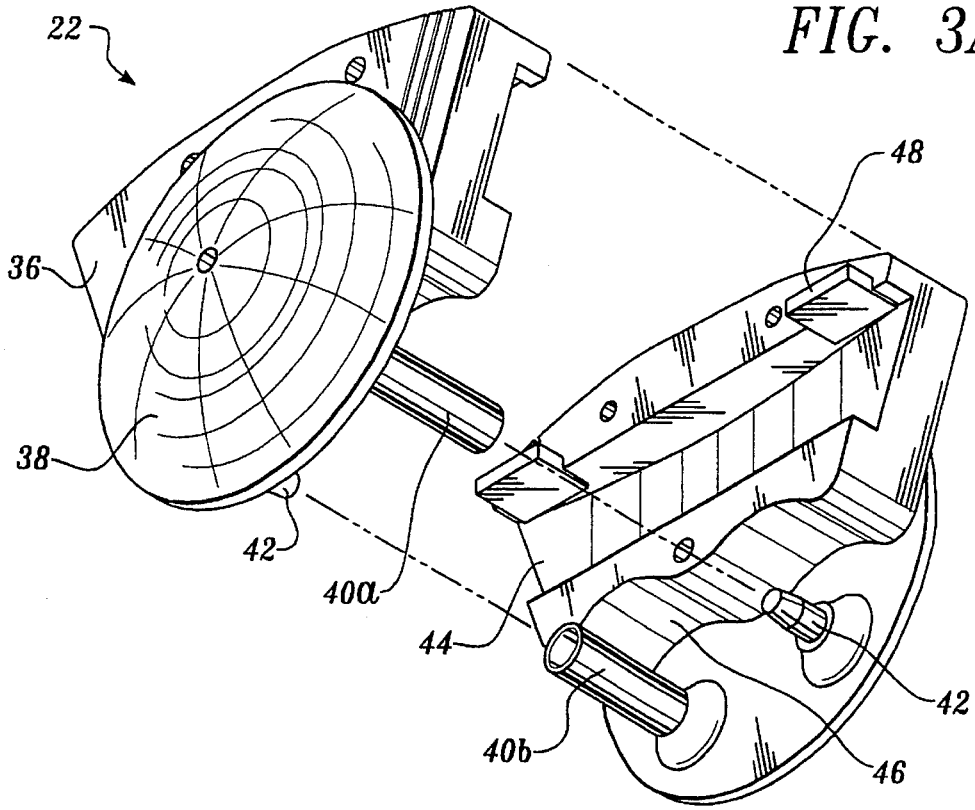
FIG. 3A is an exploded isometric view of a handgrip assembly of the present invention.
Figure 3B:
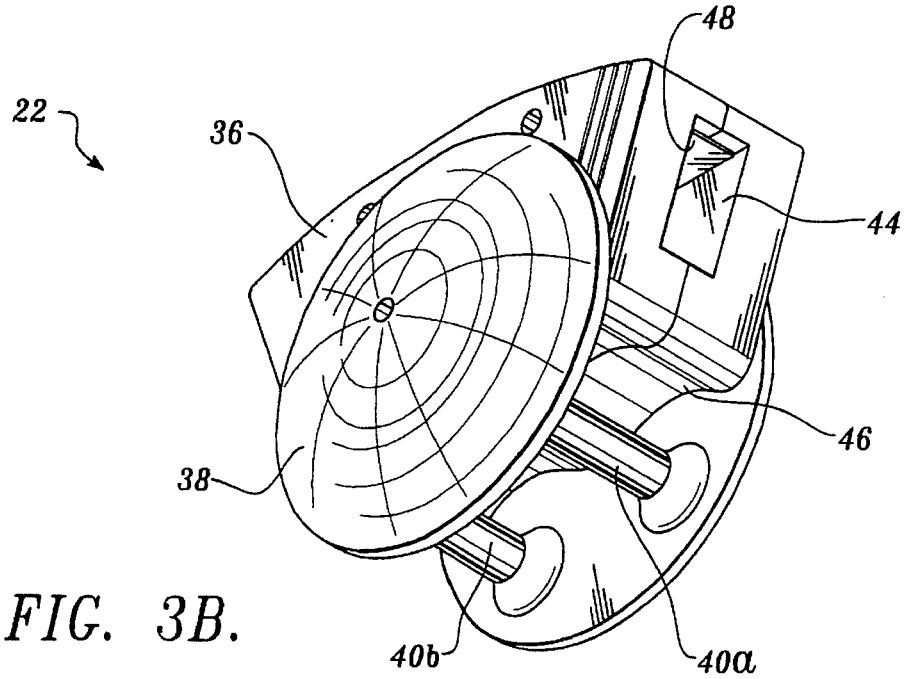
FIG. 3B is an assembled view of the handgrip assembly illustrated in FIG. 3A.

Referring now to FIGS. 3A and 3B, handgrip assemblies 22 will be described in more detail. Each handgrip assembly 22 includes a body 36, two domes 38, and two handles 40. Handgrip assemblies 22 are preferably constructed of a plastic material, and are bolted or screwed together from two halves. Each half of handgrip assembly 22 is essentially identical to the other half. Each half of body 36 has a C-shaped cross section, with a cross-sectional major axis oriented vertically. The longitudinal axis of each body 36 is horizontal and disposed along one of rails 18. Each half of body 36 is placed around one of rails 18 with the open C-shaped halves coming together to form a channel 44 within which rail 18 passes. Because rails 18 are preferably curvilinear, the lateral sides of channel 44 bow outwardly to accommodate the gentle S-shaped curves of rails 18. Thus, channel 44 is narrower at both ends of body 36 and gradually wider toward the center of body 36. Because of the narrowness of the ends of channels 44, lateral and rotational slop of handgrip assemblies 22 on rails is reduced.

A partition 46 disposed along the bottom of body 36 separates channel 44 from handles 40. Partition 46 prevents the hands of the users from contacting rails 18.

Domes 38 project outwardly and extend downwardly from either side of body 36. Domes 38 are disk-shaped with a rounded outer surface and a vertical, flat inner surface, the flat inner surfaces facing one another. Domes 38 are formed of plastic integrally with body 36. One handle 40 projects inwardly from the downwardly extending, flat inner sides of each of domes 38. Handles 40 form open sleeves at their ends to receive posts 42 projecting from the inner surface of the opposing dome. Each of posts 42 is of a diameter to snugly fit within the sleeves of handles 40. Posts 42 are tapered at their ends for easy and accurate alignment and coupling of handles 40. Handles 40 and posts 42 project beneath channels 44 in directions perpendicular to channel 44. With one handle 40 and one post 42 projecting side by side from each of domes 38, once the two halves of body 36 are secured together, two handles per handgrip assembly 22 are created.

To facilitate sliding along rails 18, blocks 48 are secured within recesses 50 in the top of channel 44. One of blocks 48 is fitted within the top of each end of channel 44. Although blocks 48 are secured within recesses 50, they project below the top surface of channel 44. Blocks 48 are parallelepiped in shape and provide a smooth surface on which handgrip assembly 22 rests on one of rails 18. Preferably, blocks 48 are made of material that resists wear to a higher degree than the remainder of body 36. Blocks 48 may also reduce friction on rails 18. Blocks 48 are preferably constructed of ultrahigh molecular weight (UHMW) polyethylene.

Figure 4:
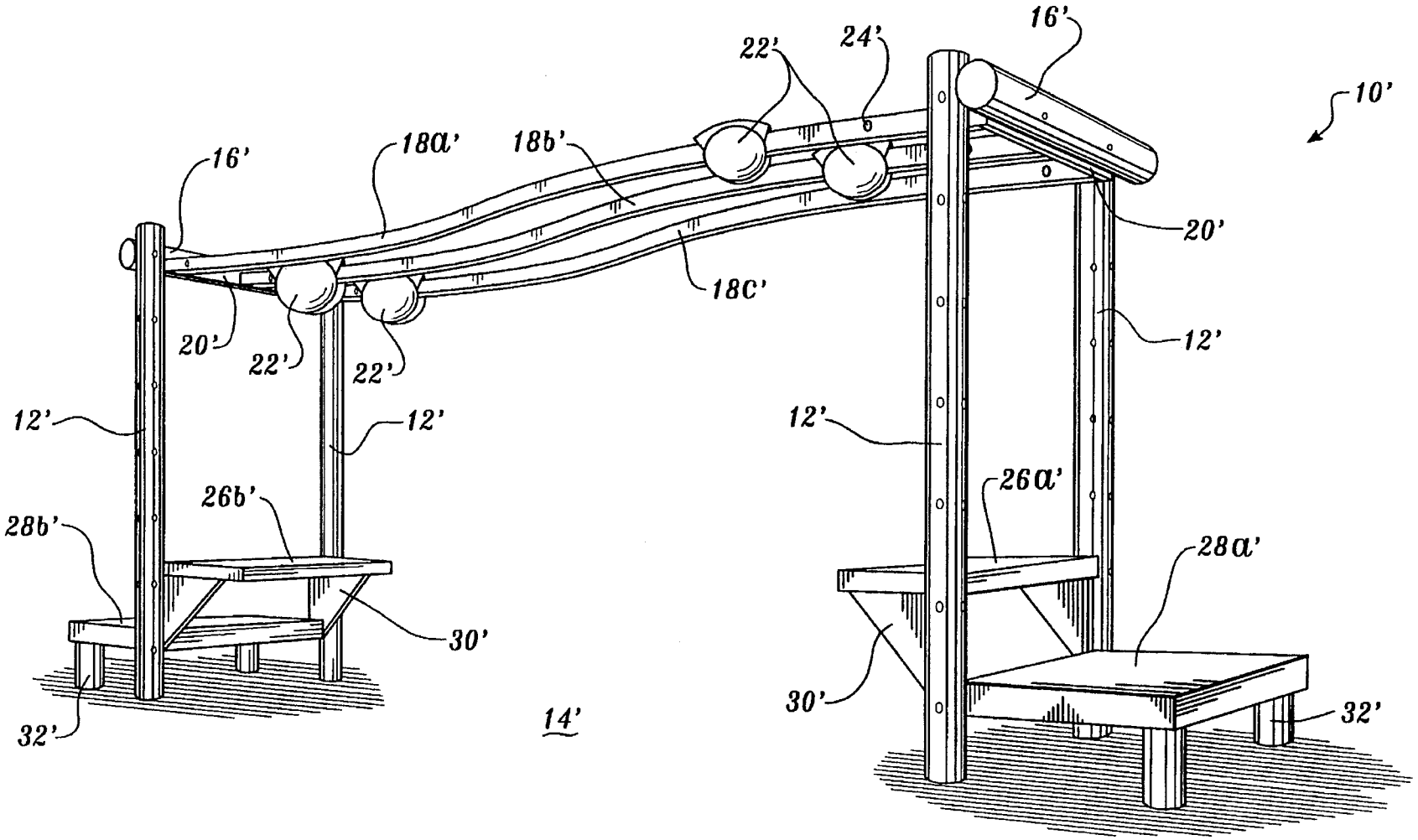
FIG. 4 is a perspective view of an alternate embodiment of the playground apparatus of the present invention.

FIG. 4 illustrates an alternate embodiment of playground structure 10', which includes only three rails 18'. The construction of playground structure 10' is otherwise consistent with the description above of playground structure 10 illustrated in FIGS. 1 through 3B. Other embodiments could be created with only two rails, or with almost any number of rails. The rails may be curvilinear or straight, and may not always be horizontal. Rails 18 could even form circular or other closed-loop paths. Handgrip assemblies 22 may also have alternate constructions, including rollers or other devices to decrease friction. Handgrip assemblies 22 may also have fewer or greater numbers of handles 40 or may be attached to more than one rail. In other embodiments, rigid rails may not be used. Instead, taut cables or any other substantially horizontal members supported off the ground may be used. Handgrip assemblies 22 would be arranged and configured to frictionally engage the members. The rails or other members are preferably substantially horizontal so that the user can traverse back and forth across the members.

While the preferred embodiments of the invention have been illustrated and described, it will be appreciated that various changes can be made therein without departing from the spirit and scope of the invention.

The embodiments of the invention in which an exclusive property or privilege is claimed are defined as follows:

1. An amusement apparatus for users to traverse while hanging by their hands above a ground surface, the apparatus comprising:

(a) at least three substantially horizontal members positioned side by side, each of said substantially horizontal members having a generally smooth, unobstructed top surface along substantially the entire length of said horizontal members, wherein said substantially horizontal members include first ends and second ends, said substantially horizontal members being smooth and unobstructed between said ends;

(b) at least one handgrip assembly frictionally coupled to each of said substantially horizontal members, each handgrip assembly including at least one handle, said handgrip assemblies being continuously and smoothly slidable along substantially the entire length of said substantially horizontal members, each of said handgrip assemblies having a surface riding on one of said substantially horizontal members such that, when one of said handgrip assemblies is unweighted, it will smoothly slide along one of said substantially horizontal members while, when weighted, said handgrip assembly holds onto the smooth top of substantially horizontal members, wherein said handgrip assemblies each include a channel having a closed top side and two ends, an opening being disposed at each end, each of said channels slidably engaging one of said substantially horizontal members, the top side of said channel riding on the top of one of said substantially horizontal members, the length of said channel being greater than the height of said channel, such that said handgrip assembly rides smoothly on one of said substantially horizontal members without substantial rockering; and (c) a structure for supporting said substantially horizontal members above the ground surface, said first and second ends being attached to said structure;

wherein said substantially horizontal members include curved portions along their length, and wherein said channels are wider near their middles than near their ends so that said handgrip assemblies accommodate said curved portions of said substantially horizontal members, the ends providing closer fitting engagement with the sides of said substantially horizontal members to eliminate lateral sloppiness of said handgrip assemblies on said substantially horizontal members.

2. An amusement apparatus for users to traverse while hanging by their hands above a ground surface, the apparatus comprising:

(a) at least three substantially horizontal members positioned side by side, each of said substantially horizontal members having a generally smooth, unobstructed top surface along substantially the entire length of said horizontal members, wherein said substantially horizontal members include first ends and second ends, said substantially horizontal members being smooth and unobstructed between said ends, wherein said substantially horizontal members are equally spaced relative to each other along substantially all of their length and include curved portions along their length;

(b) at least one handgrip assembly frictionally coupled to each of said substantially horizontal members, each handgrip assembly including at least one handle, said handgrip assemblies being continuously and smoothly slidable along substantially the entire length of said substantially horizontal members such that, when one of said handgrip assemblies is unweighted, it will smoothly slide along one of said horizontal members while, when weighted, said handgrip assembly holds onto the smooth top of said substantially horizontal member, each of said handgrip assemblies having a surface riding on one of said substantially horizontal members, wherein said handgrip assemblies are slidably frictionally engaged on said substantially horizontal members, wherein each of said handgrip assemblies includes a channel having a closed top side slidably engaging one of said substantially horizontal members, said surface being within the top side of said channel and riding on the top surface of said substantially horizontal members, said channel having two ends through which said substantially horizontal members extend, said channel having a length and a height, the length being greater than the height, such that said handgrip assembly slides smoothly and without substantial rockering on one of said substantially horizontal members, wherein said channels are wider near their middles than near their ends so that said handgrip assemblies accommodate said curved portions of said substantially horizontal members, the ends providing close fitting engagement with the sides of said substantially horizontal members to eliminate lateral sloppiness of said handgrip assemblies on said substantially horizontal members; and (c) a structure for supporting said substantially horizontal members above the ground surface, said first and second ends being attached to said structure.

3. An apparatus for a user to slide across above a ground surface while hanging by the user's hands, the apparatus comprising:

(a) a support structure;

(b) a first rail attached to said support structure above a ground surface, said first rail having a generally smooth, unobstructed top surface along substantially the entire length of said first rail;

(c) a second rail attached to said support structure in an adjacent, spaced relationship to said first rail, said second rail having a generally smooth, unobstructed top surface along substantially the entire length of said second rail, wherein said first and second rails are disposed substantially along a horizontal plane and wherein said first and second rails are curved;

(d) a first slider slidably frictionally engaging said first rail and including at least one first grip for the user's hand, said first grip being disposed below the first rail, said first slider being movable by the user along said first rail when most of the weight of the user is not being supported by said first slider on said first rail, said first slider being continuously and smoothly slidable along substantially the entire length of said first rail such that the user can slide said first slider without lifting said first slider; and (e) a second slider slidably frictionally engaging said second rail and including at least one second grip for the user's hand, said second grip being disposed below the second rail, said second slider being movable by the user along said second rail when most of the weight of the user is not being supported by said second slider on said second rail, said second slider being continuously and smoothly slidable along substantially the entire length of said second rail such that the user can slide said second slider without lifting said second slider;

wherein said first and second slider assemblies include slider channels in which said rails are received, said slider channels having lateral sides that curve outwardly toward their middles to accommodate said rails that are curved, the ends of the channels providing closer fitting engagement with the sides of said rails to substantially eliminate lateral sloppiness of said slider assemblies on said rails.

* * * * *